United States Patent [19]

Howells et al.

[11] Patent Number: 4,880,162

[45] Date of Patent: Nov. 14, 1989

[54] GAS ATOMIZATION NOZZLE FOR METAL POWDER PRODUCTION

[75] Inventors: Roger A. Howells, Orefield; George H. Stoner, Coopersburg, both of Pa.; Joseph Stockunas, Huntington Beach, Calif.

[73] Assignee: Air Products and Chemicals, Inc., Allentown, Pa.

[21] Appl. No.: 207,096

[22] Filed: Jun. 15, 1988

[51] Int. Cl.[4] ..... B05B 7/10

[52] U.S. Cl. ..... 239/406; 239/417; 239/424; 239/600; 425/7

[58] Field of Search ..... 239/405, 406, 415, 417, 239/416.5, 423, 424, 600; 425/7, 10, 460

[56] References Cited

U.S. PATENT DOCUMENTS

| | | | |
|---|---|---|---|
| 1,856,679 | 5/1932 | Williams et al. . | |
| 2,440,531 | 4/1948 | Zebroski | 18/2.5 |
| 3,253,783 | 5/1966 | Probst et al. | 239/82 |
| 3,501,802 | 3/1970 | Ullman et al. | 18/2.5 |
| 3,565,345 | 2/1971 | Moltzan | 239/424 X |
| 3,592,391 | 7/1971 | Bender et al. | 239/406 |
| 3,901,492 | 8/1975 | Lafferty | 266/34 |
| 4,021,167 | 5/1977 | Niimi | 425/10 X |
| 4,105,221 | 8/1978 | Schliebe | 138/44 |
| 4,356,997 | 11/1982 | Beffano | 138/45 X |
| 4,416,600 | 11/1983 | Lecznar | 425/7 |
| 4,534,917 | 8/1985 | Walz | 425/1 |
| 4,619,597 | 10/1986 | Miller | 425/7 |

FOREIGN PATENT DOCUMENTS

| | | | |
|---|---|---|---|
| 1087255 | 4/1984 | U.S.S.R. | 425/7 |
| 106095 | 4/1917 | United Kingdom | 425/7 |

*Primary Examiner*—Andres Kashnikow
*Assistant Examiner*—Kevin Weldon
*Attorney, Agent, or Firm*—James C. Simmons; William F. Marsh

[57] ABSTRACT

Gas atomization nozzle for producing metal powder from a molten bath. The nozzle is characterized in that the angle of convergence of the gas to the metal stream can be varied and total volumetric flow of gas through the nozzle can be varied and precisely controlled.

The nozzle is characterized by having a generally cylindrical shaped housing containing means to tangentially direct gas introduced from outside the housing to a recess in the inner wall of the cylinder with the tangential gas passages having means to adjust the total volumetric flow of atomizing gas through the nozzle. Disposed in the inside of the cylindrical housing juxtaposed to the recess and in combination therewith is a flow direction insert and a flow direction plate, the flow direction insert being variably positionable in relation to the flow direction plate to control the width of the spray zone. The angle of convergence of the gas exiting the nozzle in relation to a molten metal stream passed through the central aperture of the cylinder can be varied by changing the shape of the flow direction insert and/or flow direction plate.

5 Claims, 3 Drawing Sheets

GAS ATOMIZATION NOZZLE FOR METAL POWDER PRODUCTION

FIELD OF THE INVENTION

The present invention pertains to devices that supply a high pressure gas for atomizing molten metal to produce metal powder.

BACKGROUND OF THE INVENTION

Metals in powder form are used to produce many useful articles. For example, fine metal powders can be pressed and sintered into shapes such as gears and the like for use in machinery. Parts produced by means of powder metallurgy can be made to precise tolerances with minimum amounts of finishing operations and from metals that may otherwise be difficult to fabricate.

The key to producing metal powders by gas atomization is the gas atomization nozzle. The nozzle must be such that it will provide uninterrupted atomization of the molten metal stream. A high pressure gas stream passing through the gas atomization nozzle impinges upon a molten metal stream breaking up and quenching the molten stream to form metal powder. Gas pressure and flowrate are critical to the process since the metal powder particle size is directly related to the gas pressure and the flowrate is directly related to the ability of the molten metal to be adequately quenched. Present nozzle technology relies upon control of the flowrate by means of the size of the nozzle orifice. The orifice size is typically fixed or manually set prior to the production of the metal powder. Since the nozzle orifice is manually set if the size is not controlled properly excessive gas usage will result in freezing of the metal stream which halts production. Prior art devices have sought better flow control in order to provide consistent uninterrupted production and allow optimization of gas flowrate for the desired alloy and powder characteristics. In addition optimization of the flowrate would reduce gas flowrates which provides an economic benefit to the user.

U.S. Pat. No. 4,416,600 discloses and claims a nozzle which is made of several pieces wherein the nozzle insert uses a spiral channel in order to effect control of the gas flow and the resultant size of the particles produced.

U.S. Pat. No. 3,253,783 discloses and claims a gas atomization nozzle wherein the gs is introduced into a plenum chamber through tangantial slots from an annular chamber and then from the plenum chamber to passages outwardly of the nozzle around the molten metal stream to effect production of the powder.

U.S. Pat. No. 4,619,597 discloses and claims a gas atomization nozzle with specific relationship between the outer surface of the melt tube and the plenum closure plate orifice.

U.S. Pat. Nos. 1,856,679, 3,501,802, 2,440,531, 3,592,391, and 3,901,492 all disclose and claim gas atomization nozzles which have attempted to provide a control of the particle size and the gas flow.

However, with all of these prior art devices flow control has been limited to manual inspection and machine tolerance specifications between the metal tube and the surrounding orifice in order to determine the nozzle opening. Since most nozzle devices are subjected to extremely high temperatures caused by the molten metal the assembly warps and thus the orifice (annulus) changes in size and uniformity.

SUMMARY OF THE INVENTION

In order to overcome the problems with the prior art devices and provide an improved atomization nozzle the present invention defines a multi-piece nozzle that when assembled the angle of convergence of the gas to the metal stream passing through the nozzle can be varied and the total volumetric flow of gas through the nozzle can be varied and precisely controlled. Precise gas flow control is achieved by using a multiplicity of gas passages to conduct gas from an annular plenum to the nozzle orifice.

DETAILED DESCRIPTION OF THE PREFERRED EMBODIMENT

Figure 1:
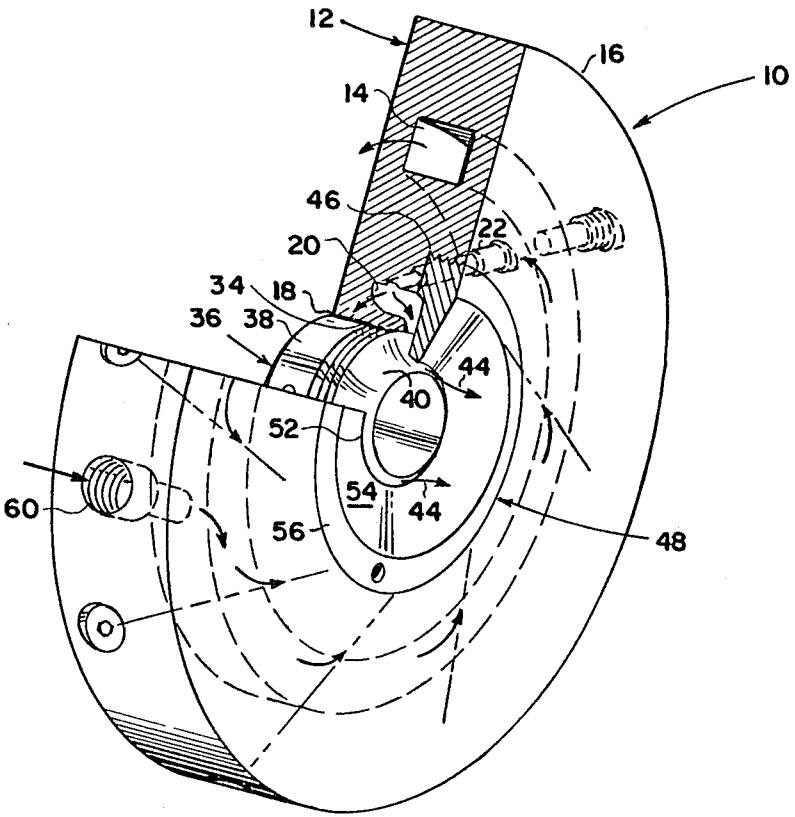
FIG. 1 is an isometric view of the nozzle according to the present invention with a portion removed to show interior details thereof.
Figure 3:
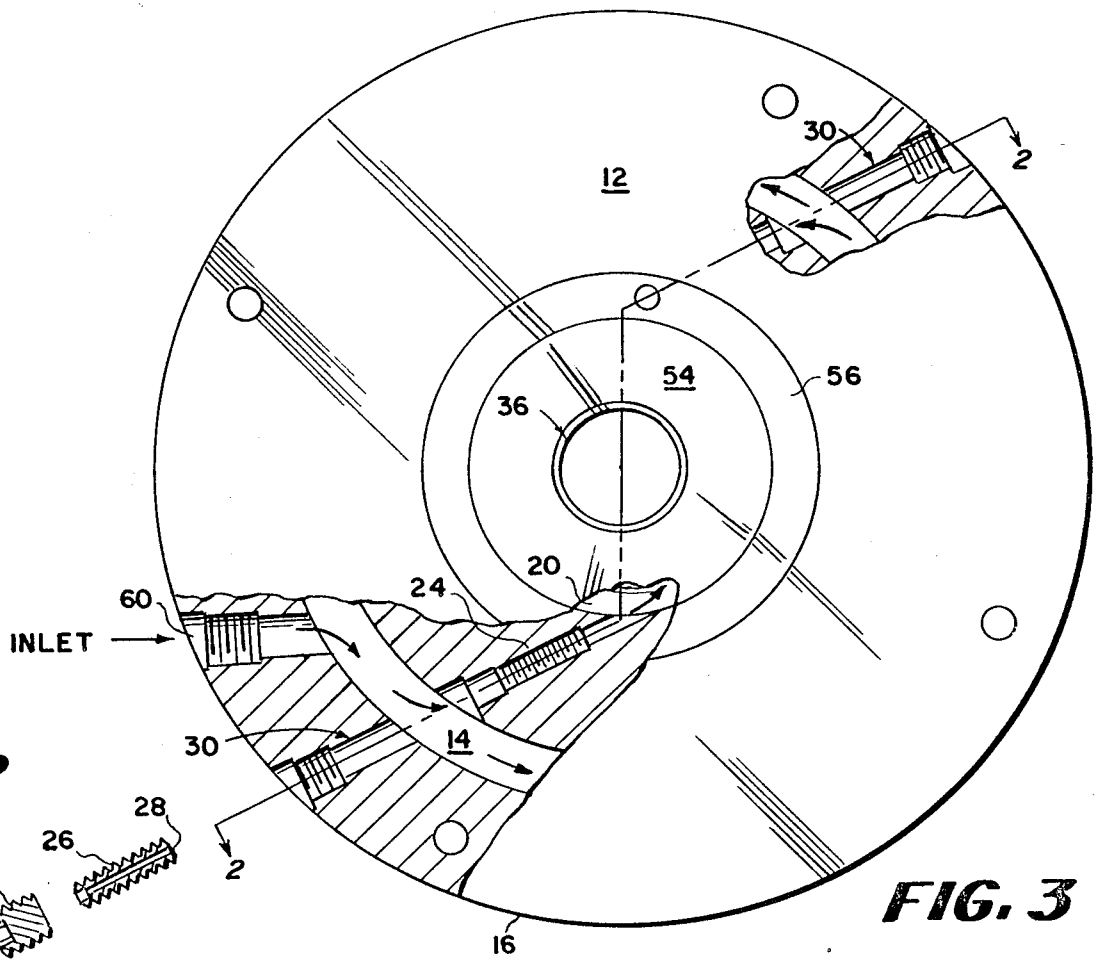
FIG. 3 is a bottom plan view of the nozzle of the present invention partially fragmentary to reveal interior details thereof.

Referring to the drawing, FIG. 1 shows an atomization nozzle 10 according to the present invention. Nozzle 10 comprises a nozzle housing 12 which is in the general shape of a torous (cylinder or doughnut). Nozzle housing 12 includes a annular internal passage 14 disposed between the outer surface 16 and the inner surface 18 of the housing or torous (cylinder or doughnut) 12. Internal passage 14 can be fabricated by any well known technique including milling the circumferential passage followed by placing a cover over the passage and welding the cover in place. Alternatively, housing 12 can be made in two pieces. On the internal portion of housing 12 there is an annular or circumferential passage 20 which communicates through a series of radial passages 22 as shown in FIG. 3 to the annular passage 14. Passages 22 are constructed so that they provide a tangantial entry into the passage 20. As shown in FIG. 3 passages 22 include a threaded section 24 adapted to receive a flow control device 26. Flow control device 26 can be in the form of a socket head set screw with an internal passage 28 to permit gas to pass from the annular passage 14 to the internal passage 20. Also passages 22 are extended in the form of bore and counterbore 30 to open onto the outer surface 16 of housing 12. The outer portion 30 of the gas passages is adapted to be closed by a plug 29 to prevent reverse gas flow out of the passages 30 and to permit access to socket head set screws 26.

Housing 12 contains an internal female threaded portion 34 in the central bore of the torous to receive a flow direction insert 36. Flow direction insert 36 has a first section 38 of generally cylindrical shape and a second section 40 having a tapered or frusto-conical portion. Flow direction insert 36 can be threaded into the housing 12 and secured in place by set screws 42 as shown in FIG. 2.

Figure 2:
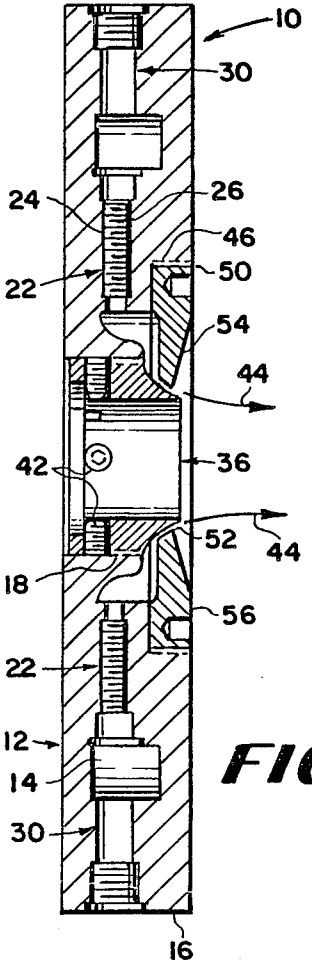
FIG. 2 is a section taken along the lines 2—2 of FIG. 3.

Flow direction insert 36 is positioned in relation to annular passage 20 so that a gas flowing out of annular passage 20 is forced to flow along the frusto-conical surface 40 in the direction of the arrows 44 shown in FIGS. 1 and 2.

Housing 12 includes a counterbored or shelf section 46 of annular shape which is adapted to receive a flow direction plate 48. Flow direction plate 48 is fabricated in the shape of a flat washer like structure having a circular outer surface 50 which is suitably threaded to mate with female threads on surface 46 of housing 12. Flow direction plate 48 has a central aperture 52 which is tapered complimentary to the taper of frusto-conical section 40 of flow direction insert 36 to thus define an annular flow path between section 40 of flow direction insert 36 and surface 52 of flow direction plate 48 as shown by the arrows 44. The bottom face 54 of flow direction plate 48 may be tapered outwardly or in a diverging manner from surface 52 toward the flat surface 56 which terminates in the surface 46 of flow direction plate 48.

When nozzle 10 is assembled as described above, there is a fixed orifice of precise circular cross-section for the passage of atomizing gas toward the molten stream which is conducted through the flow direction insert in an axial direction. Atomizing gas is introduced to the housing via gas inlet 60 which contains a suitable threaded connection to receive a source of atomizing gas such as argon or nitrogen. Depending upon the molten metal to be atomized and a final desired particle size, socket head screws 26 are positioned in the passages 24 to provide the required precise total volumetric flow of gas. Flow control ports or passages 24 upstream of the annulus or annular flow path determined by flow direction insert 36 and flow direction plate 48 permits flow control of gas independent of gas flow pattern exiting the annulus. This is so because with the nozzle of the present invention the size of the annulus does not have to be varied to change the flow rate of gas through the nozzle. It is also possible to provide the frusto-conical portion 40 of flow direction insert 36 and surface 52 of flow direction plate 30 with matching included angles in sets for angles of converence between 7.5 and 60° to the longitudinal axis of the nozzle 10.

The nozzle of the present invention permits adjustment of flow and direction with separate components. Thus, the swirl velocity can be kept high even though the atomizing angle is changed by changing the flow direction insert and the flow direction plate. The rate of flow can be varied by both changing the diameter of the orifice screw opening (socket head screw 26) and the number of screws utilized. In a preferred embodiment of the invention, there are eight gas passages identical to passage 22 disposed equally around the circumference of housing 12. It is also possible to use different angular configurations for the flow direction insert and the flow direction plate to give a desired flow pattern. The need to change angles may be caused by vessel shape, flow velocity, properties of the atomized material (e.g. temperature, viscosity, density, and the like) and, by alterning the area of the swirling atomizing cone and the particle size desired. The self-centering screw assembly of the flow direction plate and the flow direction insert prevent irregular shaped flow patterns due to misalignment as was common with the prior art devices.

Figure 4:
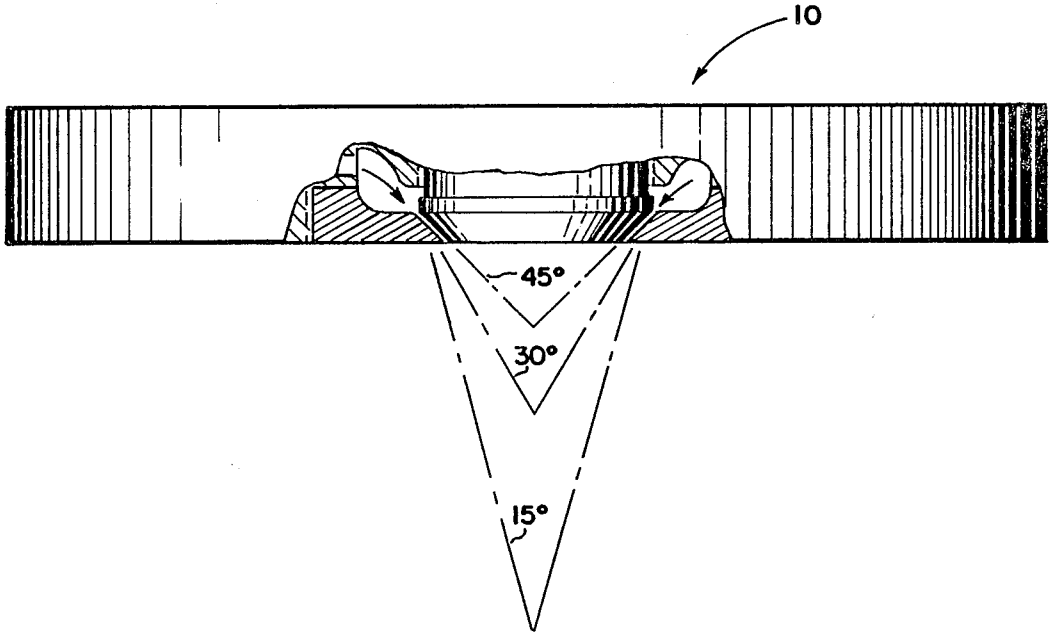
FIG. 4 is a schematic representation of the point of convergence of the gas stream to the center line of the nozzle according to the present invention for several different flow direction plates and flow direction inserts.

FIG. 4 shows different points of convergence along the longitudinal axis of the atomizing device 10 for angles of convergence of 15°, 30°, or 45°. However, we have found that the flow direction plates and flow direction inserts can be mixed (interchanged) to provide different angles and/or different flow patterns for the atomization fluid to produce flow patterns which results in different particle shapes and sizes. Angles of convergence of from 7.5° to 60° are within the scope of this invention.

Thus, the invention provides a nozzle where high pressure gas is supplied to the nozzle assembly, the gas is distributed to uniformly spaced concentric flow ports aligned tangential to the nozzle annulus in order to provide a swirling high pressure gas stream upon exit from the nozzle. Each flow port contains a flow control plug which can be varied to determine the flow rate through the nozzle. Thus, the invention provides better flow control by removing the annular orifice as the total flow control device. The use of flow control ports provides uniformity in controlling the flow of high pressure gas to provide the control stream for atomization of the metal.

Having thus described our invention what is desired to be secured to Letters Patent of the United States as set forth in the appended claims.

We claim:

1. A nozzle assembly for use in producing particulate metals by a gas atomization process comprising in combination:

a gas nozzle housing having a generally cylindrical shape with an outer wall and an inner wall, said housing including means to direct an atomization from an inlet to a generally circumferential recess disposed in the inner wall of said cylindrical housing;

said means to direct said atomization gas including an annular passage disposed between said inlet and said recess and a plurality of generally tangential flow passages for conducting atomizing gas from said annular passage to said recess, each of said tangential flow passages including means to control the volumetric flow of said gas from said annular passage to said recess; and a flow direction insert removably disposed within said inner wall of said housing, to in combination with a generally annular shaped flow direction plate removably disposed within said housing and juxtaposed to said flow direction insert and in combination therewith to define means for directing atomization gas to a point of convergence along the center line of said cylindrical housing;

whereby the total volumetric flow of gas through said nozzle can be varied without disassembling the annular flow plate and the flow direction insert.

2. A nozzle according to claim 1 wherein said flow direction insert has a generally hollow cylindrical shape on a first end communicating with and terminating in a generally frusto-conical shape on a second end, said flow direction insert being adapted to be positioned variably relative to said flow direction plate to variably control the width of the spray zone of said gas existing said nozzle.

3. A nozzle according to claim 1 wherein said flow direction insert and said housing include complementary threaded portions to removably secure said insert to said nozzle housing.

4. A nozzle according to claim 1 wherein said flow direction plate has a generally flat washer-like shape with a portion of one surface of the plate defining a radially outwardly diverging surface which in combination extending from a central aperture having an inwardly converging surface to a location adjacent the outer surface of said plate.

5. A nozzle according to claim 3 wherein said complimentary surfaces of said flow direction insert and said flow direction plate are made in sets having included angles of between 7.5 and 60 degrees to a longitudinal center line of each.

* * * * *